313-422 SR
12/26/78 OR 4,131,823

United States Patent [19] [11] 4,131,823
Credelle [45] Dec. 26, 1978

[54] MODULAR FLAT DISPLAY DEVICE WITH BEAM CONVERGENCE

[75] Inventor: Thomas L. Credelle, East Windsor, N.J.

[73] Assignee: RCA Corporation, New York, N.Y.

[21] Appl. No.: 838,658

[22] Filed: Oct. 3, 1977

[51] Int. Cl.[2] ..... H01J 29/72
[52] U.S. Cl. ..... 313/422; 313/408; 313/400
[58] Field of Search ..... 313/422, 408, 400; 315/366

[56] References Cited

U.S. PATENT DOCUMENTS 4,028,582 6/1977 Anderson et al. ..... 313/422

*Primary Examiner*—Robert Segal
*Assistant Examiner*—Darwin R. Hostetter
*Attorney, Agent, or Firm*—J. M. Whitacre; G. H. Bruestle; D. S. Cohen

[57] ABSTRACT

An envacuated envelope has substantially flat, parallel front and back walls and spaced, parallel support walls extending between and perpendicular to the front and back walls and forming a plurality of channels. Beam guides extend along each of the channels for guiding three beams along each channel and for selectively deflecting the beams at selected points along the channel toward a phosphor screen on the front wall. Between the beam guides and the phosphor screen are deflection electrodes for deflecting the beams transversely across the channel so as to scan the portion of the phosphor screen which extends across the channel. Also between the beam guides and the phosphor screen is means forming an electron lens for converging the three beams at a point spaced from but adjacent to the screen. The phosphor screen is preferably made up of different color emitting phosphor bodies with each beam impinging on a different color phosphor, and the beams are converged at a shadow mask which extends across the channel adjacent to but spaced from the screen.

8 Claims, 3 Drawing Figures

MODULAR FLAT DISPLAY DEVICE WITH BEAM CONVERGENCE

The present invention relates to a modular flat display device and particularly to such a display device in which the three beams in each channel are converged.

BACKGROUND OF THE INVENTION

U.S. Pat. No. 4,028,582 to C. H. Anderson et al, issued June 7, 1977, entitled "Guided Beam Flat Display Device" describes a modular flat display device in which a relatively flat, evacuated envelope is divided into parallel channels by support walls extending between and substantially perpendicular to substantially parallel front and back walls of the envelope. Along each channel are three beam guides for guiding three parallel beams of electrons along the channel and for selectively deflecting the beams at selective points along the channel toward a phosphor screen on the front wall of the envelope. Between the beam guide and the phosphor screen are deflection electrodes which simultaneously deflect the three beams transversely across the channel so that all three beams transversely scan the entire portion of the screen which extends across the channel. The phosphor screen is made up of a sequence of triads of bodies of three different color emitting phosphors and each beam in the channel impinges on a different color phosphor. A shadow mask extends across the channel adjacent the screen and the beams pass through openings in the shadow mask.

A problem with the above modular flat display device is that the three beams in each channel follow substantially parallel paths as the beams are deflected across the channel. Thus, in order for each beam to scan the entire portion of the screen two of the beams must overscan onto the support wall at each side of the channel. This results in a relatively high peak beam current and a relatively high scan power for operating the display device.

SUMMARY OF THE INVENTION

A modular flat display device of the type previously described includes means between the beam guides and the phosphor screen for forming an electron lens for converging the three beams at a point spaced from but adjacent to the screen, e.g. at the shadow mask.

DETAILED DESCRIPTION OF THE INVENTION

Figure 1:
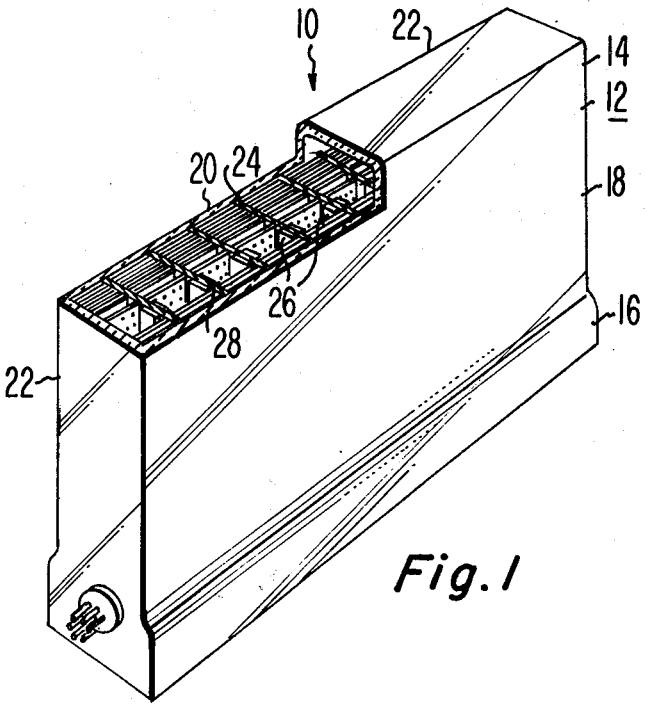
FIG. 1 is a perspective view, partially broken away of a form of the flat display device of the present invention.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular, substantially flat front wall 18 which supports the viewing screen and a rectangular, substantially flat back wall 20 in spaced parallel relation to the front wall 18. The front wall 18 and back wall 20 are connected by side walls 22. The front wall 18 and back wall 20 are dimensioned to provide the size of the viewing screen desired, e.g. 75 × 100 centimeters, and are spaced apart about 7.5 centimeters.

A plurality of spaced, parallel support walls 24 are secured between and substantially perpendicular to the front wall 18 and the back wall 20 and extend from the gun section 16 to the opposite side wall 22. The support walls 24 provide the desired internal support for the evacuated envelope 12 against external atmospheric pressure and divide the display section 14 into a plurality of parallel channels 26.

Figure 2:
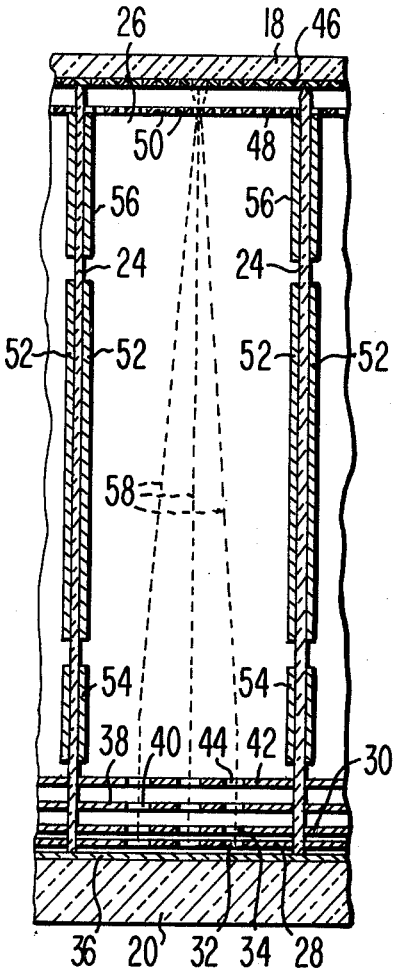
FIG. 2 is a sectional view transversely across one of the channels of the display device.

In each of the channels 26 is an electron beam guide assembly of the type described in the copending application for U.S. Patent of W. W. Siekanowicz et al, Serial No. 671,358, filed Mar. 29, 1976, entitled "Flat Display Device With Beam Guide" now U.S. Pat. No. 4,088,920, issued May 9, 1978. The beam guide assembly includes a pair of spaced, parallel beam guide plates 28 and 30 extending transversely across and longitudinally along the channel 26 from the gun section 16 to the opposite side wall 22. As shown in FIG. 2, the beam guide plate 28 is adjacent and parallel to the back wall 20 and the beam guide plate 30 is on the side of the beam guide plate 28 toward the front wall 18. The beam guide plates 28 and 30 have a plurality of openings 32 and 34 respectively therethrough. The openings 32 and 34 are arranged in a plurality of rows transversely across the channel 26 and in three rows longitudinally along the channel 26. Each of the openings 34 in the beam guide plate 30 is aligned with a separate opening 32 in the beam guide plate 30. Each longitudinal row of the openings 32 and 34 functions as a separate beam guide so that there are three beam guides in each of the channels 26. On the inner surface of the back wall 20 are a plurality of spaced parallel conductors 36 which extend transversely across the channels 26 with each conductor 36 extending along a separate transverse row of the openings in the beam guide plates. The conductors 36 may be strips of a conductive metal coated on or bonded to the back wall 20.

Spaced from and parallel to the beam guide plate 30 is a focusing grid plate 38 which extends transversely across and longitudinally along the channel 26. The focusing grid plate 38 has a plurality of openings 40 therethrough. The openings 40 are arranged in rows transversely across and longitudinally along the channel 26 with each opening being aligned with a separate one of the openings 34 in the beam guide plate 30. Spaced from and parallel to the focusing grid plate 38 is an acceleration grid plate 42 which extends transversely across and longitudinally along the channel 26 and has a plurality of openings 44 therethrough. The openings 44 are also arranged in rows transversely across and longitudinally along the channel 26 with each opening being aligned with a separate opening 40 in the focusing grid plate 38. The beam guide plates 28 and 30, the focusing grid plate 38 and the acceleration grid plate 42 may be secured together in a single assembly of the type shown and described in the copending application for U.S. Patent of K. D. Peters, Serial No. 783,218, filed Mar. 31, 1977, entitled "Guided Beam Flat Display Device With Focusing Guide Assembly Mounting Means". This assembly may be mounted in the channel 26 in the manner also described in said copending application, Serial No. 783,218.

On the inner surface of the front wall 18 is a phosphor screen 46. The phosphor screen 46 is preferably made up of bodies of phosphors which emit three different colors, e.g. red, green and blue, when excited by electrons with the phosphor bodies being disposed in a regular repetitive array of groups of three. The phosphor bodies may be in the form of strips extending longitudinally along the channels 26 or may be circular or any other shape and arranged in a desired pattern on the front wall 18. A shadow mask 48 extends transversely across each of the channels 26 adjacent to but spaced from the phosphor screen 46. The shadow mask 48 has openings 50 therethrough through which at least portions of electron beams can pass to reach the phosphor screen 46.

Along each of the channels 26 are a pair of spaced, parallel scanning electrodes 52 which extend along and are preferably on the support walls 24. Extending along each of the channels 26 between the scanning electrodes 52 and the acceleration grid plate 42 are a pair of spaced, parallel first guard electrodes 54. The first guard electrodes 54 also extend along and are preferably on the support walls 24, and are spaced from both the scanning electrodes 52 and the acceleration grid plate 44. Extending along each of the channels 26 between the scanning electrodes 52 and the shadow mask 50 are a pair of spaced, parallel second guard electrodes 56. The second guard electrodes 56 also extend along and are preferably on the support walls 24. The second guard electrodes 56 are spaced from the scanning electrodes 52 but can contact the shadow mask 50 so as to be electrically connected thereto. The scanning electrodes 52, first guard electrode 54 and second guard electrode 56 are films of a conductive material, such as a metal, which are either coated on or bonded to the support walls 24.

In the gun section 16 and at the end of each of the channels 26 is means for generating electrons and directing the electrons in the form of beams along each of the channels. Three beams of electrons are directed into each of the channels 26 with the beams being directed between the beam guide plates 28 and 30 and with each beam being directed along a separate longitudinal row of the openings in the guide plates. The beam generating and directing means may be individual guns, each of which includes three cathodes for generating the three beams, and suitable grids for modulating and directing the beams into the channels 26. Alternatively, the beam generating and directing means may be a line cathode extending along the ends of the channels 26 or individual line cathodes extending across the ends of one or more of the channels. The line cathode or cathodes would include electrodes for forming the electrons into beams, for modulating the beams, and for directing the beams into the channels. One such line cathode is shown and described in the copending application for Letters Patent of R. A. Gange, Serial No. 784,365, filed Apr. 4, 1977, entitled "Cathode Structure and Method of Operating the Same".

In the operation of the display device 10 a high positive potential, typically about +300 volts, is applied to each of the conductors 36, and a low positive potential, typically about +40 volts, is applied to the beam guide plates 28 and 30. A very high positive potential, typically about 10 Kv, is applied to the phosphor screen 46, the shadow mask 48 and the acceleration grid plate 42. A focusing potential, typically about +1000 volts is applied to the focusing grid plate 38. The scanning electrodes have applied thereto a scanning potential of $V_s \pm V_d$ as will be explained later. The first guard electrodes 54 have the potential $V_s$ applied thereto and the second guard electrodes 56 have applied thereto the same potential applied to the shadow mask 48 and the phosphor screen 46.

The gun structure in the gun section 16 generates electrons and directs the electrons as beams into each of the channels 26. The beams of electrons are directed between the beam guide plates 28 and 30 with each beam being directed along a separate longitudinal row of the openings 32 and 34 in the beam guide plates. As described in the previously referred to copending application, Serial No. 671,358, the potential differences between the beam guide plate 28 and the conductors 36, and between the beam guide plate 30 and the focusing grid plate 38 create electrostatic fields between the beam guide plates 28 and 30 which confine the electrons to the beams as the beams flow along the channels.

The beams of electrons can be selectively deflected toward the phosphor screen 46 at selected points along the channels 26 by switching the potential applied to each of the conductors 36 to a negative potential, such as −100 volts. This will cause the beams to be deflected away from the negative conductor so that the beams will pass through the adjacent openings 34 in the beam guide plate 30. Each of the beams will then pass through a separate opening 40 in the focusing grid plate 38 which will cause the electrons in each beam to be focused. Each beam will then pass through a separate opening 44 in the acceleration plate 42 and then flow toward the phosphor screen 46.

As previously stated, the first guard electrodes 54 are at a potential $V_s$, and this potential is less than the potential applied to the acceleration grid plate 42. This difference in potential creates an electrostatic field over the acceleration grid plate 42 which acts as an electrostatic lens to converge the three beams together. The potential $V_s$ is selected to cause the three beams to be converged together at the shadow mask 48. This convergence of the beams is indicated by the dashed lines 58 which indicate the paths of the three beams. The particular potential necessary to achieve the convergence of the three beams depends on the distance between the acceleration grid plate and the shadow mask 48, the distance between beams, and the potential applied to the acceleration grid plate and the shadow mask. With the spacing between the acceleration grid plate and the shadow mask being about 7 centimeters and the spacing between the beams being about 0.5 centimeters, and the potential applied to the acceleration grid plate and shadow mask being about 10 Kv, a potential ($V_s$) of about 7 Kv applied to the first guard electrodes 54 will converge the beams at the shadow mask.

As the beams pass between the scanning electrodes 52, a potential of $V_s$ plus $V_d$ is applied to one of the electrodes and a potential of $V_s$ minus $V_d$ is applied to the other of the scanning electrodes. This causes the beams to be deflected toward the scanning electrode having the higher positive potential. The potential $V_d$ is picked to cause the beams to be deflected toward the higher potential scanning electrode sufficiently for the beams to impinge on the phosphor screen 46 at the point where the support wall meets the phosphor screen. For a channel 26 which is about 2.4 centimeters wide, a $V_d$ of about 1100 volts will achieve the desired deflection. The potentials applied to the two scanning electrodes 52 are then changed by lowering the potential applied to the one electrode from $V_s+V_d$ to $V_s-V_d$ and raising the potential applied to the other electrode from $V_s-V_d$ to $V_s+V_d$. This causes the beams to be deflected towards the opposite scanning electrode, thereby causing the beams to scan completely across the portions of the phosphor screen 46 which extends across the particular channel 26. With the beams in each of the channels 26 being scanned across its respective channel, there is provided a line scan completely across phosphor screen 46. By providing successive line scans at various points along the channels 26 a complete display will be provided over the entire phosphor screen 46.

Although the first guard electrodes 54 could be electrically connected to the scanning electrodes 52 so that the potential applied to the first guard electrodes 54 would vary with the potential applied to the scanning electrodes, it is preferable to have the first guard electrodes 54 electrically separated from the scanning electrodes so that the first guard electrodes are at a fixed potential $V_s$. The variation in the potential applied to the scanning electrodes 52 causes fringe fields at the edges of the scanning electrodes adjacent the acceleration grid plate 42 which can affect the proper focusing of the beams. By having the first guard electrodes 54 at the fixed potential, the fringe fields are spaced from the acceleration grid plate 42 and from the focusing lens so that the fringe fields do not adversely affect the focusing of the beams. Similarly, by having the second guard electrodes 56, the fringe fields generated at the edges of the scanning electrods 52 most adjacent the shadow mask 48 are spaced from the shadow mask so that they do not adversely affect convergence of the beams at the shadow mask. This results in being able to provide a uniform spacing between the points that the three beams impinge on the phosphor screen 46.

By focusing the three beams at the shadow mask 48 the three beams can be scanned completely across the channel 26 without the need of overscanning any of the beams. This reduces the peak beam current required and also reduces the scan power required. It has been found that the peak beam current can be reduced as much as 40% and the scan power can be reduced as much as 50% by converging the three beams. Although the beams can be converged by forming an electron lens between the scanning electrodes 52 and the acceleration grid plate 42, it is preferable to include the two sets of guard electrodes to minimize the adverse affects of fringe fields at the edges of the scanning electrodes and to achieve a uniform spacing between the beams at the phosphor screen 46. The electron lens in addition to converging the three beams together also focuses the electrons in each beam so that each beam has a smaller spot size.

Figure 3:
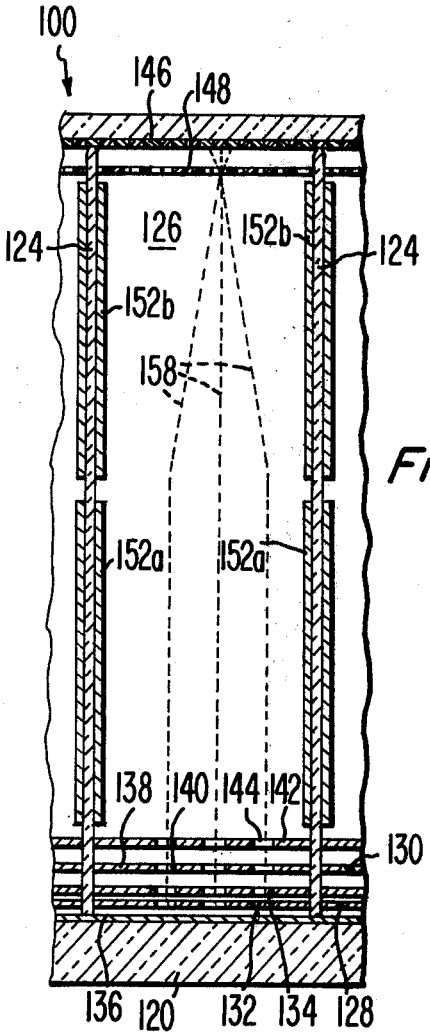
FIG. 3 is a sectional view similar to FIG. 2 showing a modification of the display device.

Referring to FIG. 3 a modification of the display device of the present invention is generally designated as 100. The display device 100 is of the same construction as the display device 10 shown in FIGS. 1 and 2 except for the electrodes on the surface of the support walls 124 between the acceleration grid plate 142 and the shadow mask 148. Instead of being a single pair of scanning electrodes and two pairs of guard electrodes, the display device 100 has two sets of scanning electrodes **152*a* and 152*b*. The first set of scanning electrodes 152*a* are adjacent the acceleration grid plate 142 and the second set of scanning electrodes 152*b* are adjacent the shadow mask 148**.

One method of operating the display device 100 is similar to that previously described for the display device 10 except that the acceleration grid plate 142 is at a potential $V_1$ which is less positive than the potential $V_2$ applied to the shadow mask 148 and the phosphor screen 146 but equal to or preferably more positive than the potential applied to the focusing grid plate 138. The first set of scanning electrodes **152*a* have applied thereto a potential of $V_1 \pm V_{s1}$ and the second set of scanning electrodes 152*b* have applied thereto a potential of $V_2 \pm V_{s2}$. The difference in potential between the two sets of scanning electrodes 152*a* and 152*b* creates an electrostatic field across the channel 126 in the region of the space between the two sets of scanning electrodes. This electrostatic field creates an electron lens which will converge the three beams of electrons 158. By having the proper difference in potential between the two sets of scanning electrodes the electrical lens will converge the three beams 158 at the shadow mask 148. Thus, the three beams 158 flowing from the beam guides through the openings 144 in the acceleration grid plate 142** will follow parallel paths until they reach the region of the electron lens and then will be converged together toward the shadow mask. The convergence of the beams from a point closer to the phosphor screen results in a closer screen to shadow mask spacing and hence a smaller spot size at the screen. This in turn allows for a more efficient shadow mask.

To scan the three beams simultaneously across the phosphor screen 146, voltages $V_1+V_{s1}$ and $V_2+V_{s2}$ are applied to the first and second scanning electrodes **152*a* and 152*b* respectively at one side of the channel 126 and voltages $V_1-V_{s1}$ and $V_2-V_{s2}$ are applied to the first and second scanning electrodes at the other side of the channel. As previously described with regard to the operation of the display device 10, this causes the beams to be deflected toward the scanning electrodes which are at the higher positive potential. The potentials applied to the scanning electrodes of each set are then changed in the manner previously described to cause the beams to be deflected transversely across the channel 126 and thereby scan the phosphor screen 146. Since the potentials $V_1$ and $V_2$ applied to the two sets of scanning electrodes 152*a* and 152*b* are different, the potentials $V_{s1}$ and $V_{s2}$ are different. It has been found that for a display device in which the distance between the acceleration grid plate 142 and shadow mask 148 is about 7 cm, the width of the channel 126** is about 2.4 cm, and the spacing between the beams is about 0.5 cm, $V_{s1}$ and $V_{s2}$ of about 13% of $V_1$ and $V_2$ respectively would provide the proper scanning of the beams. Thus, for such a display device in which $V_1$ is 3 Kv and $V_2$ is 10 Kv, $V_{s1}$ would be about 0.4 Kv and $V_{s2}$ would be about 1.3 Kv.

In another method of operating the display device 100, the first set of scanning electrodes **152*a* would be set at a potential $V_s$ slightly more positive than the potential $V_1$ applied to the acceleration grid plate 142 but less positive than the potential $V_2$ applied to each of the second scanning electrodes and the shadow mask. The potential difference between the first set of scanning electrodes 152*a* and the acceleration grid plate 142 creates an electrostatic field across the channel 126 adjacent the acceleration grid plate which acts as a diverging electrical lens. Thus, the beams emerging through the openings 144 in the acceleration grid plate 142 will be spread apart slightly before reaching the converging electrical lens in the region between the first and second scanning electrodes 152*a* and 152*b* which converges the beams at the shadow mask. Diverging the beams prior to converging them has the advantage that the converging angles are made larger which results in a smaller required spacing between the shadow mask 148 and the phosphor screen 146**. As previously stated this results in a smaller spot size of the beams on the screen and a more efficient shadow mask. However, it also results in the need of a slightly greater potential on the scanning electrodes to achieve the converging of the beams.

I claim:

1. In a display device which comprises an evacuated envelope having substantially flat, parallel spaced front and back walls and spaced, substantially parallel support walls extending between and substantially perpendicular to said front and back walls, said support walls dividing said envelope into a plurality of channels, means at one end of each of said channels for generating electrons and directing the electrons as beams into said channels with three beams being directed into each channel, beam guides along each of said channels for confining the electrons in the beam as the beams travel longitudinally along the channel and for selectively deflecting the beams toward a phosphor screen on the front wall of the envelope at selected points along the channels, and means in each channel between the beam guides and the phosphor screen for deflecting the beams transversely across the channel so that the beams scan the phosphor screen, the improvement comprising means in each channel for forming an electrostatic field transversely across the channel which acts as an electron lens for converging the three beams at a point adjacent to but spaced from the phosphor screen.

2. A display device in accordance with claim 1 including in each channel an acceleration grid plate extending across the channel adjacent the beam guides, said acceleration grid plate having openings therethrough through which the beams pass when deflected from the beam guides towards the phosphor screen, a shadow mask extending across the channel adjacent the phosphor screen, said shadow mask having openings therethrough through which at least portions of the beams pass, and the electron lens converges the beams at the shadow mask.

3. A display device in accordance with claim 2 in which the means in each channel for forming the electrostatic field includes a pair of spaced, parallel electrodes extending along the channel adjacent the acceleration grid plate and between which the three beams pass as the beams flow from the acceleration grid plate to the phosphor screen.

4. A display device in accordance with claim 3 in which the electrodes forming the converging lens electrostatic field also are at least a part of the means for deflecting the beams transversely across the channel.

5. A display device in accordance with claim 4 in which the means in each channel for deflecting the beams transversely across the channel includes two sets of spaced, parallel electrodes with one set being adjacent the acceleration grid plate and the other set being adjacent the shadow mask, the two sets of electrodes being adapted to form the converging lens electrostatic field in the region between the two sets of electrodes.

6. A display device in accordance with claim 5 in which the set of electrodes adjacent the acceleration grid plate is adapted to form with the acceleration grid plate an electrostatic field which forms an electron lens for diverging the beams as the beams pass from the acceleration grid plate.

7. A display device in accordance with claim 3 in which the electrodes are adapted to form the converging lens electrostatic field with the acceleration grid plate and a separate set of spaced, parallel scanning electrodes are provided in each channel between the first said pair of electrodes and the shadow mask for deflecting the beams transversely across the channel.

8. A display device in accordance with claim 7 including a third set of spaced, parallel electrodes in each channel between the scanning electrodes and the shadow mask, said third set of electrodes being electrically connected to the shadow mask.

* * * * *